US011988399B2

(12) United States Patent
Zhu et al.

(10) Patent No.: US 11,988,399 B2
(45) Date of Patent: May 21, 2024

(54) CENTRAL AIR-CONDITIONING SYSTEM

(71) Applicant: Ningbo Fotile Kitchen Ware Co., Ltd., Ningbo (CN)

(72) Inventors: Qihui Zhu, Ningbo (CN); Ang Li, Ningbo (CN); Haifeng Fu, Ningbo (CN); Yaqun Cao, Ningbo (CN); Bingsong Yu, Ningbo (CN)

(73) Assignee: Ningbo Fotile Kitchen Ware Co., Ltd., Ningbo (CN)

( * ) Notice: Subject to any disclaimer, the term of this patent is extended or adjusted under 35 U.S.C. 154(b) by 609 days.

(21) Appl. No.: 17/250,532

(22) PCT Filed: Aug. 2, 2019

(86) PCT No.: PCT/CN2019/098977
§ 371 (c)(1),
(2) Date: Feb. 1, 2021

(87) PCT Pub. No.: WO2020/025036
PCT Pub. Date: Feb. 6, 2020

(65) Prior Publication Data

US 2021/0310669 A1 Oct. 7, 2021

(30) Foreign Application Priority Data

Aug. 2, 2018 (CN) ..... 201810867392.X

(51) Int. Cl.
*F24F 1/0011* (2019.01)
*F24F 1/0063* (2019.01)
*F24C 15/20* (2006.01)
*F24F 7/08* (2006.01)
(Continued)

(52) U.S. Cl.
CPC ..... *F24F 1/0011* (2013.01); *F24C 15/20* (2013.01); *F24C 15/2035* (2013.01);
(Continued)

(58) Field of Classification Search
CPC ..... F24F 1/0011; F24F 1/0323; F24F 1/0063; F24F 5/0096; F24F 7/08; F24F 13/02;
(Continued)

(56) References Cited

U.S. PATENT DOCUMENTS 8,382,565 B2 * 2/2013 Dawson ..... F16L 3/01 165/56
10,871,304 B2 * 12/2020 Costello ..... F24F 13/26
(Continued)

FOREIGN PATENT DOCUMENTS

CN 202767473 U * 3/2013
CN 111609441 A * 9/2020 ..... F24C 15/2021
CN 113432197 A * 9/2021

*Primary Examiner* — Raheena R Malik
(74) *Attorney, Agent, or Firm* — Wang Law Firm, Inc.

(57) ABSTRACT

A central air-conditioning system, comprises a plurality of air-conditioning assemblies (1) and a plurality of range hood assemblies (2); each air-conditioning assembly (1) comprises a compressor (11), a first heat exchanger (12) and a second heat exchanger (13) which are connected with each other through refrigerating medium pipes (14); all the range hood assemblies (2) are in communication with the public flue (6); a third heat exchanger (3) and the second heat exchanger (13) is connected through a secondary refrigerant channel (4); each end of each secondary refrigerant channel (4) respectively exchanges heat with the second heat exchanger (13) and the third heat exchanger (3). As all the range hood assemblies (2) are in communication with the public flue (6), the third heat exchanger (3) exchanges heat with the second heat exchangers (13) through the secondary refrigerant channel (4), when the system is operating, the heat energy generated by the air-conditioning assemblies (1) can be discharged through the public flue (6).

10 Claims, 3 Drawing Sheets

(51) Int. Cl.

| | |
|---|---|
| | ***F24F 13/06*** |
| (2006.01) | ***F24F 13/30*** |
| (2006.01) | ***F24F 13/02*** |
| (2006.01) | ***F24F 1/0323*** |
| (2019.01) | ***F24F 5/00*** |
| (2006.01) | |

(52) U.S. Cl.
CPC ..... *F24F 1/0063* (2019.02); *F24F 1/0323* (2019.02); *F24F 5/0096* (2013.01); *F24F 7/08* (2013.01); *F24F 13/02* (2013.01); *F24F 13/0227* (2013.01); *F24F 13/06* (2013.01); *F24F 13/30* (2013.01); *F24F 2221/18* (2013.01)

(58) Field of Classification Search
CPC ..... F24F 13/0227; F24F 2007/002; F24F 13/06; F24F 13/30; F24F 2221/18; F24C 15/20; F24C 15/2035
See application file for complete search history.

(56) References Cited

U.S. PATENT DOCUMENTS

| | | | | |
|---|---|---|---|---|
| 11,236,915 | B1 * | 2/2022 | Cameron | F24F 8/158 |
| 11,592,205 | B2 * | 2/2023 | Bauch | F24F 13/02 |
| 2009/0301693 | A1 * | 12/2009 | Dawson | F24F 13/10 165/56 |
| 2018/0128512 | A1 * | 5/2018 | Costello | F24F 13/06 |
| 2018/0283727 | A1 * | 10/2018 | Grabon | B66B 11/00 |
| 2019/0313588 | A1 * | 10/2019 | Zimmerman | A01G 9/1423 |
| 2020/0191432 | A1 * | 6/2020 | Bauch | F24F 13/02 |
| 2021/0222907 | A1 * | 7/2021 | Costello | F24F 13/06 |
| 2021/0310669 | A1 * | 10/2021 | Zhu | F24F 5/0096 |
| 2021/0318003 | A1 * | 10/2021 | Fu | F24F 13/06 |
| 2021/0348774 | A1 * | 11/2021 | Yu | F24F 7/065 |
| 2022/0290879 | A1 * | 9/2022 | Fischer | F24F 5/0096 |

* cited by examiner

CENTRAL AIR-CONDITIONING SYSTEM

TECHNICAL FIELD OF THE INVENTION

The present invention relates to a central air-conditioning system, in particular to a central air-conditioning system capable of cooling air inside the kitchen.

BACKGROUND OF THE INVENTION

As a main place for people to cook, the kitchen air environment directly affects the mood of the cook. Especially in summer, the sultry kitchen environment brings great discomfort to the cook. Accordingly, various kitchen air-conditioners have been proposed to cool the kitchen.

There is no significant difference between the existing kitchen air-conditioners and common air conditioners. There are generally two forms of kitchen air-conditioners. One form is split kitchen air-conditioner. That is, the outdoor unit is located outdoors, the indoor unit is located indoors, and the indoor and outdoor units each have a motor fan. The connection of the indoor and outdoor units in the split kitchen air-conditioner is realized by pipelines. Such a connection requires the formation of a hole on the wall, which destroys the decoration. Since the outdoor unit is hung outdoors, the structure is not compact enough and it is less aesthetically pleasing. The other form is integrated kitchen air-conditioner. That is, a dual-axis motor or two motors may be used. The integrated kitchen air-conditioner usually comprises a portable air conditioner and a window unit. When the portable air conditioner is used, it needs to be manually connected to the heat dissipation hose, and then the hose needs to be placed outside the window, which is inconvenient to use. It is necessary to form a large square hole on the wall, into which the window unit is placed. When not in use, the window unit may be moved from the hole. Although the square hole may be blocked with other things, it is messy and it destroys the decoration.

Due to the limited space in the kitchen, the kitchen air conditioner should be not too large in size. Therefore, the heat dissipation of the kitchen air conditioner becomes a challenging problem. If the in-time heat dissipation of the kitchen air conditioner fails during its use, the energy efficiency of the air conditioner will be greatly reduced. However, the existing kitchen air conditioner and the range hood operate independently of each other, and they cannot be linked. The heat energy generated by the kitchen air conditioner cannot be exhausted to the outside through the fan of the range hood. Therefore, how to exhaust the heat energy generated by the kitchen air conditioner through the range hood becomes an urgent problem. In addition, the existing kitchen air-conditioning system is separately disposed in an individual kitchen. How to integrate a central air-conditioning system into the kitchen air-conditioning system remains to be further studied.

SUMMARY OF THE INVENTION

It is an object of the present invention to provide a central air-conditioning system in which the range hood assemblies in one group of kitchens can share one air-conditioning assembly for heat exchange.

For achieving the above object, the central air-conditioning system for installing in a building with a plurality of kitchens and a public flue, the system comprises: a plurality of air-conditioning assemblies and a plurality of range hood assemblies; each air-conditioning assembly comprising a compressor, a first heat exchanger and a second heat exchanger which are connected with each other through refrigerating medium pipes; each range hood assembly having an air outlet; wherein, each range hood assembly is disposed inside each kitchen in the building, and all the range hood assemblies in the building are in communication with the public flue; a third heat exchanger is disposed inside the public flue, the second heat exchanger of each air-conditioning assembly is connected with the third heat exchanger through a secondary refrigerant channel with two ends; the secondary refrigerant from one end of each secondary refrigerant channel exchanges heat inside the corresponding second heat exchanger, and the secondary refrigerant from the other end of each secondary refrigerant channel exchanges heat inside the third heat exchanger.

In order to smoothly exhaust the fume in the public flue, preferably, a flue fan with an air inlet and an air outlet is disposed inside the public flue, the air outlet of each range hood assembly is in communication with the air inlet of the flue fan, and the air outlet of the flue fan communicates with the outside of the building.

In order to ensure the range hood assemblies to normally suck the fume, preferably, each range hood assembly comprises a fan for exhausting the fume from each kitchen to the public flue.

Preferably, each building has a plurality of stairwells, each stairwell has two groups of kitchens, each group of kitchens corresponds to one air-conditioning assembly and one group of range hood assemblies, each group of range hood assemblies corresponds to one air-conditioning assembly, and the second heat exchanger of each air-conditioning assembly is communicated with the third heat exchanger through the corresponding secondary refrigerant channel.

In order to enable the secondary refrigerant to circulate in the secondary refrigerant channel, preferably, a driving pump is disposed on the secondary refrigerant channel to drive the secondary refrigerant to flow in the secondary refrigerant channel. The secondary refrigerant may be water, ethylene glycol, glycerol, etc.

In order to ensure the air-conditioning assembly to supplement air to the kitchen, preferably, the system further comprises a sharing air duct communicating with each kitchen; each air-conditioning assembly has a fresh air inlet and a fresh air outlet, and the fresh air outlet in communication with each kitchen through the sharing air duct.

In order to ensure the air blown out from the fresh air outlet cleaner, preferably, a fresh air purification device is disposed inside the air duct between the fresh air inlet and the fresh air outlet.

Preferably, the first heat exchanger is an evaporator having an air outlet, the second heat exchanger is a condenser, and the air outlet of the evaporator is the fresh air outlet. In this way, the heat energy generated by the condenser can enter the public flue and be discharged through the flue fan.

The air-conditioning assembly can be various structures. Preferably, each air-conditioning assembly comprises a housing, and the housing has a first chamber and a second chamber; the compressor and the condenser are disposed in the first chamber, the evaporator and a fan working together with the evaporator are disposed in the second chamber, and the fresh air outlet is formed on the second chamber of the housing.

Further preferably, the fresh air inlet is formed on the second chamber of the housing, the fresh air inlet and the fresh air outlet are respectively disposed on two opposite sides of the housing, and the fresh air purification device is disposed in the second chamber, the fresh air purification device is adjacent to the fresh air inlet, and the evaporator is adjacent to the fresh air outlet.

Compared with the prior art, the present invention has the following advantages. In the present invention, each range hood assembly of the central air-conditioning system is disposed in each kitchen in the building, and is connected to the public flue, and the third heat exchanger disposed in the public flue is in communication with and exchanges heat with the second heat exchangers of the air-conditioning assemblies through the secondary refrigerant channel. When the system is operating, the heat energy generated by the air-conditioning assemblies can be discharged through the public flue. The whole structure of the present invention is simple and novel, highly practicable, and suitable for promotion and application.

DETAILED DESCRIPTION OF THE INVENTION

The present invention will be further described below in detail with reference to the accompanying drawings by embodiments.

Figure 1:
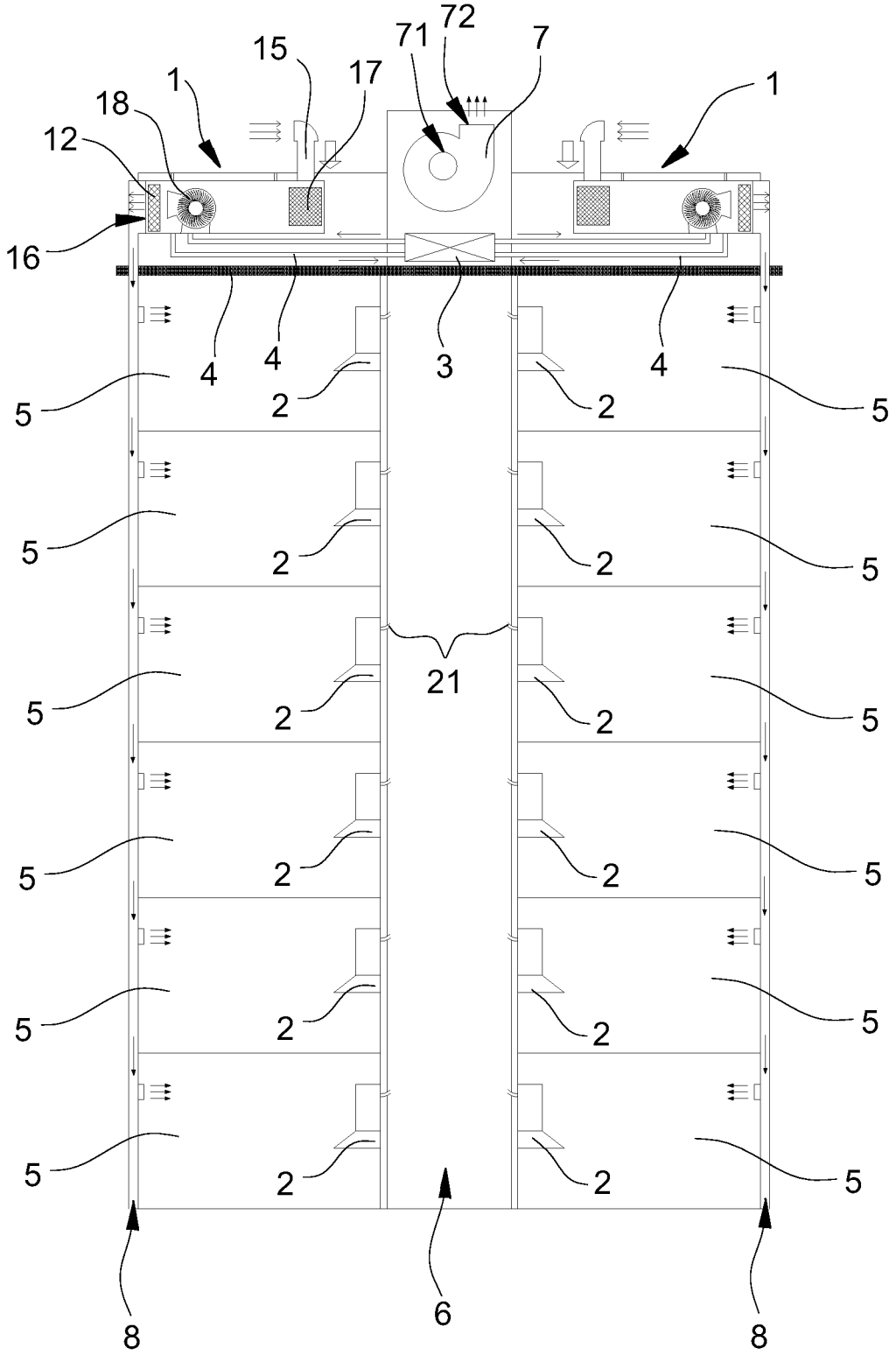
FIG. 1 is a view of a central air-conditioning system according to an embodiment of the present invention.
Figure 2:
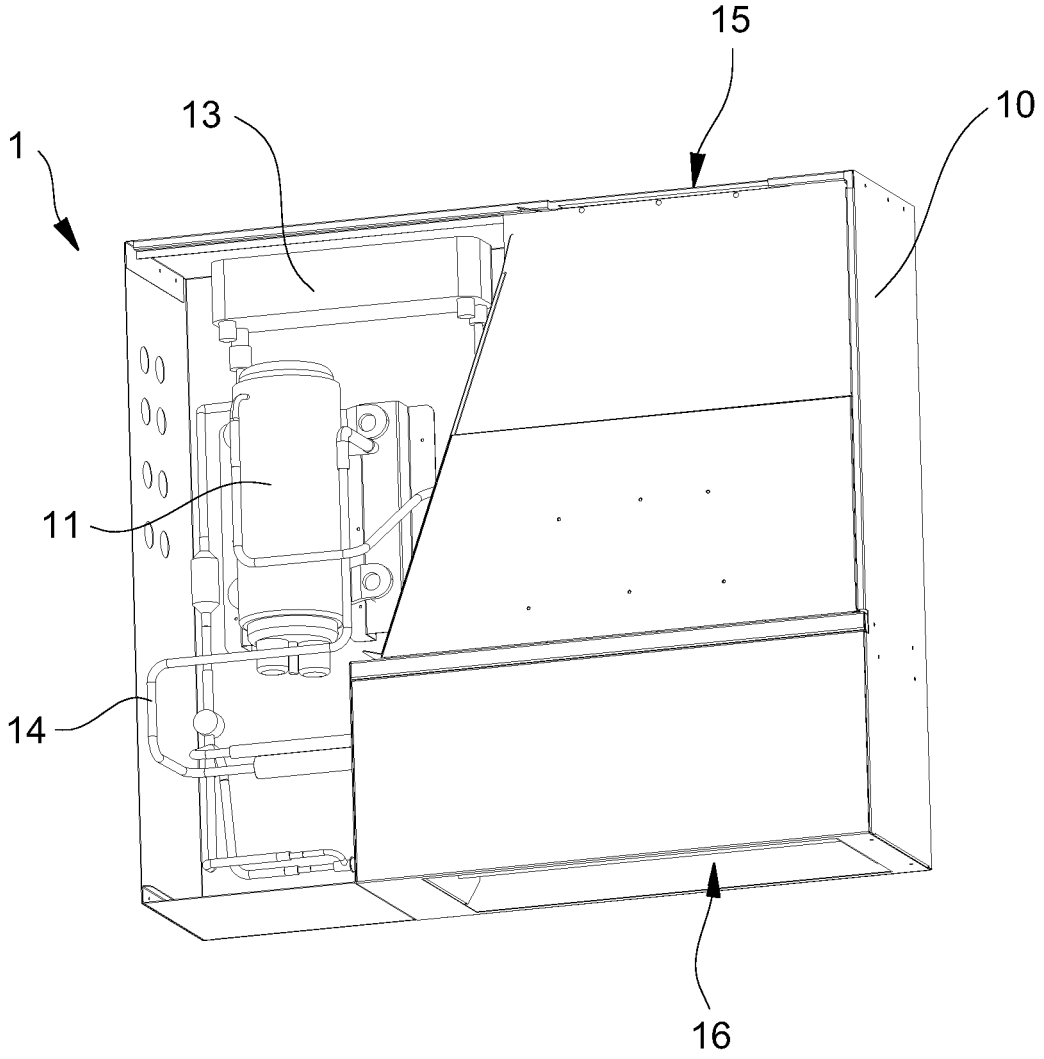
FIG. 2 is a perspective view of an air-conditioning assembly according to the embodiment of the present invention.
Figure 3:
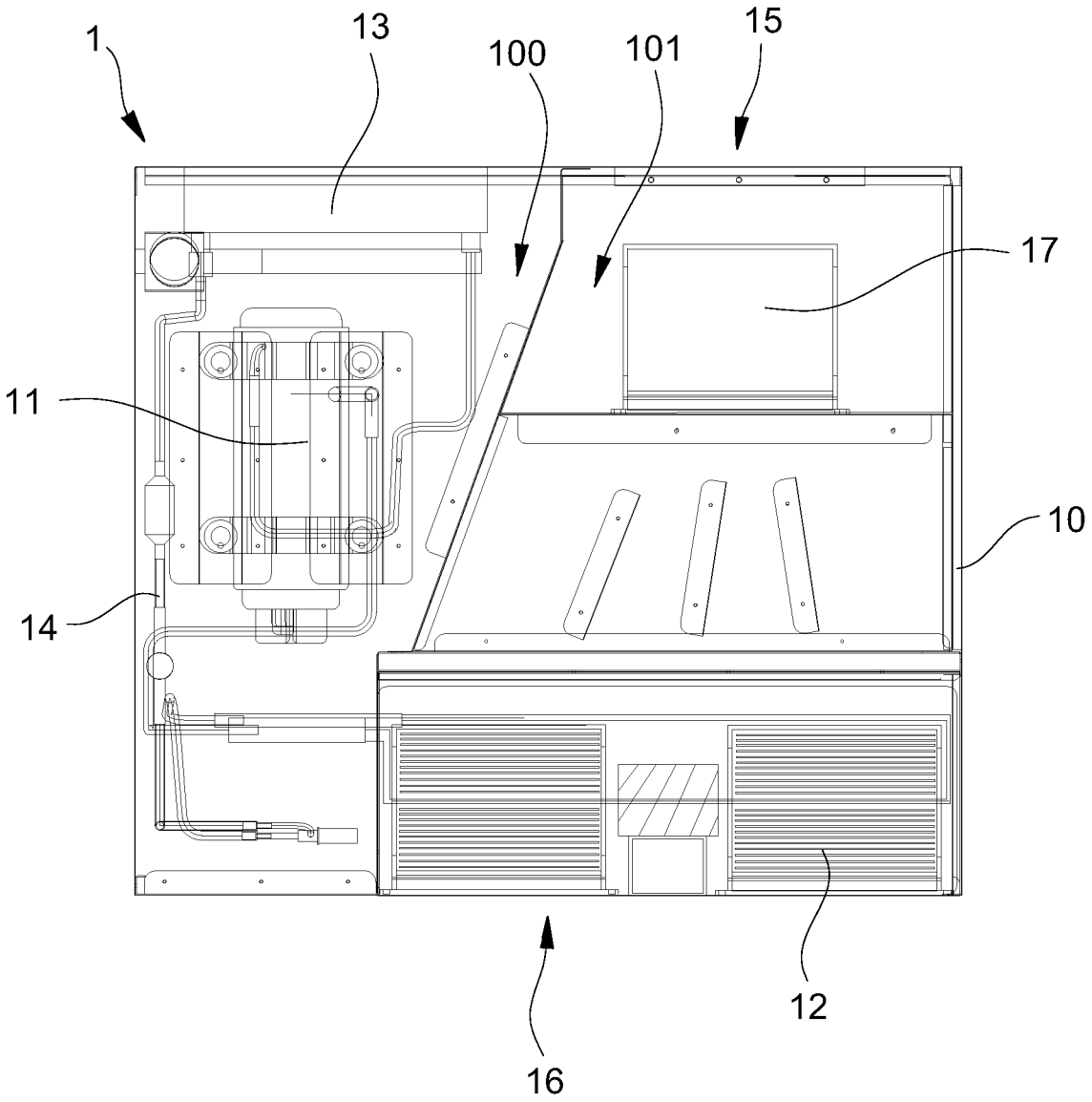
FIG. 3 is a view showing the internal structure of the air-conditioning assembly according to the embodiment of the present invention.

FIGS. 1 to 3 show a preferred embodiment of the central air-conditioning system of the present invention. The system is installed in a building with a plurality of kitchens 5 and a public flue 6. The central air-conditioning system comprises a plurality of air-conditioning assemblies 1 and a plurality of range hood assemblies 2; each air-conditioning assembly 1 comprising a compressor 11, a first heat exchanger 12 and a second heat exchanger 13 which are connected with each other through refrigerating medium pipes 14. A four-way valve (not shown) is disposed on the refrigerating medium pipes 14. The operating principle of the air-conditioning assembly 1 is the same as that of the existing air conditioner, and will not be repeated here.

Each building has a plurality of stairwells, each stairwell has two groups of kitchens, two groups of kitchens are respectively distributed at two sides of each stairwell, and each range hood assembly 2 is disposed inside each kitchen 5 in the building, and all the range hood assemblies 2 in the building are in communication with the public flue 6, a third heat exchanger 3 is disposed inside the public flue 6, the second heat exchanger 13 of each air-conditioning assembly 1 is connected with the third heat exchanger 3 through a secondary refrigerant channel 4 with two ends. A driving pump is disposed on the secondary refrigerant channel 4 to drive the secondary refrigerant to flow inside the secondary refrigerant channel 4, the secondary refrigerant may be water, ethylene glycol, glycerol, etc. The secondary refrigerant from one end of each secondary refrigerant channel 4 exchanges heat inside the corresponding second heat exchanger 13, and the secondary refrigerant from the other end of each secondary refrigerant channel 4 exchanges heat inside the third heat exchanger 3.

In this embodiment, each group of kitchens of one stairwell corresponds to one air-conditioning assembly 1 and one group of range hood assemblies 2, each group of range hood assemblies 2 corresponds to one air-conditioning assembly 1, and two second heat exchangers 13 of two air-conditioning assemblies 1 are communicated with the third heat exchanger 3 through the corresponding secondary refrigerant channel 4.

Each range hood assembly 2 comprises a fan for exhausting the fume from each kitchen to the public flue 6. A flue fan 7 with an air inlet 71 and an air outlet 72 is disposed inside the public flue 6, the air outlet 21 of each range hood assembly 2 is in communication with the air inlet 71 of the flue fan 7, and the air outlet 72 of the flue fan 7 communicates with the outside of the building. The fume in the public flue 6 is exhausted to the outside through the flue fan 7.

The air-conditioning assembly 1 in this embodiment can provide fresh air for each kitchen. In detail, the system further comprises two sharing air ducts 8 each communicating with each kitchen 5, each air-conditioning assembly 1 has a fresh air inlet 15 and a fresh air outlet 16. A fresh air purification device 17 is disposed inside the air duct between the fresh air inlet 15 and the fresh air outlet 16, and the fresh air outlet 16 in communication with each kitchen 5 through one sharing air duct 8.

Usually, by switching a four-way valve, the first heat exchanger is used as an evaporator, the second heat exchanger is used as a condenser, and the air outlet of the evaporator is the fresh air outlet 16.

The air-conditioning assembly 1 in this embodiment further comprises a housing 10, and the housing 10 has a first chamber 100 and a second chamber 101; the compressor 11 and the condenser are disposed in the first chamber 100, the evaporator and a fan 18 working together with the evaporator are disposed in the second chamber 101, and the fresh air outlet 16 is formed on the second chamber 101 of the housing 10.

Additionally, the fresh air inlet 15 is formed on the second chamber 101 of the housing 10, the fresh air inlet 15 and the fresh air outlet 16 are respectively disposed on two opposite sides of the housing 10, and the fresh air purification device 17 is disposed in the second chamber 101, the fresh air purification device 17 is adjacent to the fresh air inlet 15, and the evaporator is adjacent to the fresh air outlet 16.

The invention claimed is:

1. A central air-conditioning system installed with a plurality of kitchens and a public flue (6), the system comprising a plurality of air-conditioning assemblies (1) and a plurality of range hood assemblies (2);

each air-conditioning assembly (1) comprising a compressor (11), a first heat exchanger (12) and a second heat exchanger (13) which are connected with each other through refrigerating medium pipes (14);

each range hood assembly (2) having an air outlet (21); wherein, each range hood assembly (2) is disposed inside each kitchen (5), and all the range hood assemblies (2) are in communication with the public flue (6);

a third heat exchanger (3) is disposed inside the public flue (6), the second heat exchanger (13) of each air-conditioning assembly (1) is connected with the third heat exchanger (3) through a secondary refrigerant channel (4) with two ends;

the secondary refrigerant from one end of each secondary refrigerant channel (4) exchanges heat inside the corresponding second heat exchanger (13), and the secondary refrigerant from the other end of each secondary refrigerant channel (4) exchanges heat inside the third heat exchanger (3).

2. The system of claim 1, wherein a flue fan (7) with an air inlet (71) and an air outlet (72) is disposed inside the public flue (6), the air outlet (21) of each range hood assembly (2) is in communication with the air inlet (71) of the flue fan (7), and the air outlet (72) of the flue fan (7) communicates externally.

3. The system of claim 2, wherein each range hood assembly (2) comprises a fan for exhausting the fume from each kitchen to the public flue (6).

4. The system of claim 1, wherein each plurality of kitchens corresponds to one air-conditioning assembly (1) and one group of range hood assemblies (2), each group of range hood assemblies (2) corresponds to one air-conditioning assembly (1), and the second heat exchanger (13) of each air-conditioning assembly (1) is communicated with the third heat exchanger (3) through the corresponding secondary refrigerant channel (4).

5. The system of claim 1, wherein a driving pump is disposed on the secondary refrigerant channel (4) to drive the secondary refrigerant to flow in the secondary refrigerant channel (4).

6. The system of claim 1, further comprising a sharing air duct (8) communicating with each kitchen (5);

each air-conditioning assembly (1) has a fresh air inlet (15) and a fresh air outlet (16), and the fresh air outlet (16) is in communication with each kitchen (5) through the sharing air duct (8).

7. The system of claim 6, wherein a fresh air purification device (17) is disposed inside the air duct between the fresh air inlet (15) and the fresh air outlet (16).

8. The system of claim 7, wherein the first heat exchanger (12) is an evaporator having an air outlet, the second heat exchanger (13) is a condenser, and the air outlet of the evaporator is the fresh air outlet (16).

9. The system of claim 8, wherein each air-conditioning assembly (1) comprises a housing (10), and the housing (10) has a first chamber (100) and a second chamber (101);

the compressor (11) and the condenser are disposed in the first chamber (100), the evaporator and a fan (18) working together with the evaporator are disposed in the second chamber (101), and the fresh air outlet (16) is formed on the second chamber (101) of the housing (10).

10. The system of claim 9, wherein the fresh air inlet (15) is formed on the second chamber (101) of the housing (10), the fresh air inlet (15) and the fresh air outlet (16) are respectively disposed on two opposite sides of the housing (10), and the fresh air purification device (17) is disposed in the second chamber (101), the fresh air purification device (17) is adjacent to the fresh air inlet (15), and the evaporator is adjacent to the fresh air outlet (16).

* * * * *